United States Patent [19]

Plessis et al.

[11] Patent Number: 4,675,892

[45] Date of Patent: Jun. 23, 1987

[54] PROCESS FOR THE CONTROL OF THE POSITION OF THE FOCUS OF AN X-RAY TUBE AND CONTROL APPARATUS PERFORMING SAID PROCESS

[75] Inventors: André Plessis, Clamart; Guy Seite, Saint Cheron, both of France

[73] Assignee: Thomson CGR, Paris, France

[21] Appl. No.: 735,358

[22] Filed: May 17, 1985

[30] Foreign Application Priority Data

May 30, 1984 [FR] France ..... 84 08489

[51] Int. Cl.[4] ..... G21K 1/00

[52] U.S. Cl. ..... 378/145; 378/126; 378/205

[58] Field of Search ..... 378/10, 12, 126, 150–151, 378/145, 204–207

[56] References Cited

U.S. PATENT DOCUMENTS

| | | | |
|---|---|---|---|
| 3,121,793 | 2/1964 | Thomas | 378/197 |
| 3,130,313 | 4/1964 | Tilling | 378/151 |
| 4,075,489 | 2/1978 | Neal et al. | 378/10 |
| 4,123,659 | 10/1978 | Oliver | 378/12 |
| 4,160,909 | 7/1979 | Froggatt | 378/12 |
| 4,162,420 | 7/1979 | Grady | 378/126 |
| 4,404,591 | 9/1983 | Bonar | 358/111 |
| 4,426,721 | 1/1984 | Shih-Ping | 378/99 |
| 4,464,778 | 8/1984 | Goldmann | 378/150 |

FOREIGN PATENT DOCUMENTS

| | | | |
|---|---|---|---|
| 0074596 | 3/1983 | European Pat. Off. . | |
| 0083465 | 7/1983 | European Pat. Off. . | |
| 2317849 | 2/1977 | France . | |
| WO82/01949-09 | 4/1982 | PCT Int'l Appl. . | |
| 0446005 | 10/1974 | U.S.S.R. | 378/207 |

OTHER PUBLICATIONS

"New Device for Accurate Measurement of the X-Ray Intensity Distribution of X-Ray Tube Focal Spots" by Doi et al. Medical Physics, vol. 2, #5 (Sep./Oct. 1975) pp. 268–273.

*Primary Examiner*—Craig E. Church
*Assistant Examiner*—John C. Freeman
*Attorney, Agent, or Firm*—Cushman, Darby & Cushman

[57] ABSTRACT

The invention relates to a process for the controlling of the position of the focus of an X-ray tube, a applicable to the monitoring of X-ray equipment equipped with X-ray tubes and to the installation of the latter in shields. The invention also relates to a control apparatus for performing the above process. According to the process of the invention, the image of the focus of an X-ray tube is produced on two X-radiation sensitive, contiguous detector means. Each of the detector means supplied an output signal, whose amplitude is a function of the distribution of said image of said detector means. The output signals are applied to a comparison means, which supplies a difference signal linked with the position of the focus along a first given axis.

22 Claims, 5 Drawing Figures

PROCESS FOR THE CONTROL OF THE POSITION OF THE FOCUS OF AN X-RAY TUBE AND CONTROL APPARATUS PERFORMING SAID PROCESS

BACKGROUND OF THE INVENTION (1) Field of the Invention

The invention relates to a process for controlling the position of the focus of an X-ray tube applicable to the monitoring of X-ray equipment equipped with X-ray tubes and to the fitting of the latter in shields. The invention also relates to a control apparatus for performing this process.

(2) Description of the Prior Art

In per se known manner, an X-ray assembly comprises an X-ray tube equipped with a target, called an anode, as well as an electron emitter, called a cathode. The cathode emits electrons in a directional manner, in order to form an electron beam, said electron beam striking the target very locally in a very small area called the X-radiation focus. The anodes and cathodes are contained in an envelope, in which there is a vacuum which aids thermoelectronic emission. Together the envelope and the electrode form the X-ray tube.

To permit its normal use, the X-ray tube is contained in a shield which protects the user from high voltage and X-radiation, contains the high voltage insulating oil necessary for operation and fixes the tube relative to the X-ray outlet port.

Only part of the X-radiation emitted from the focus is used and this is generally shaped like a cone, whose apex is the focus and whose cross-section is defined by the opening of the shield outlet port.

An essential condition for obtaining the requisite geometrical qualities of the X-radiation beam consists of the centering of the focus relative to said outlet port. Thus, in general, the focus is centered relative to the outlet port, in such a way that the geometrical axis of the latter passes through the focus. This geometrical axis of the outlet port consequently constitutes the axis of the useful X-radiation beam.

In order to form the X-ray assembly, the shield equipped with the X-ray tube is combined with a device, such as a beam limiter or localizer. For this purpose, the geometrical shapes of the outlet port of the shield are such that they serve as a reference for the mechanical assembly of the equipped shield and e.g. the beam limiter. The alignment of the axis of the beam limiter opening on the axis of the X-radiation beam is greatly simplified as a result of the prior centering of the focus.

X-ray assembly designers measure the centering of the X-ray focus compared with mechanical references on the outlet port. Use is made of a X-radiation sensitive detector or receiver means, such as, e.g., a camera fixed to the outlet port and bearing on the reference faces of the latter. This camera also has elements making it possible to form the image of the focus on a film or screen on which, by means of wires or etchings, is materialized the theoretical axis of the outlet port. The offcentering of the image of the focus makes it possible to calculate the offcentering of the focus relative to the port axis, as a function of the geometrical characteristics of the camera.

This method suffers from the disadvantages that it leads to the blocking of the useful irradiation field during the measurement, makes it necessary to interpret results, which prevents real time measurements and offers a limited sensitivity, so that there is a lack of accuracy. Apart from the problem caused by these disadvantages in connection with the control of the position of the focus for the centering thereof, they prevent the use of said method for controlling the position of the focus during the operation of the X-ray equipment to which the X-ray tube belongs.

It is in fact very important to know possible variations of the spatial position of the focus because, in certain circumstances, they can have serious consequences with regards to the quality of an X-ray picture.

SUMMARY OF THE INVENTION

The present invention relates to a process for controlling the position of the focus of an X-ray tube, which permits an instantaneous and very accurate control of the position of the focus, both in a factory or laboratory control, and during the real operation of a radiological installation.

The present invention therefore relates to a process for controlling the position of the focus of an X-ray tube, in which an image of said focus is obtained with the aid of a pinhole camera and makes it possible to carry out said position control along at least a first given axis, said X-ray tube being contained in a shield and produces an X-ray beam passing out of the shield through an outlet port, where in it comprises centering the pinhole camera on a reference axis intersecting said first axis at a point constituting a reference position relative to which said control is performed, then forming said image on the input planes of at least two contiguous, X-radiation sensitive, detector means, said input planes constituting a useful measurement length and being separated by a median line through which passes the reference axis and on either side of which is distributed the said image, followed by the comparison of the output signals generated by each of the detector means as a function of the distribution of the image, so as to obtain a difference signal having a zero value when the focus occupies said reference position.

BRIEF DESCRIPTION OF THE DRAWINGS

The invention is described in greater detail hereinafter relative to non-limitative embodiments and with reference to the attached drawings, wherein show.

DESCRIPTION OF THE INVENTION

Figure 1:
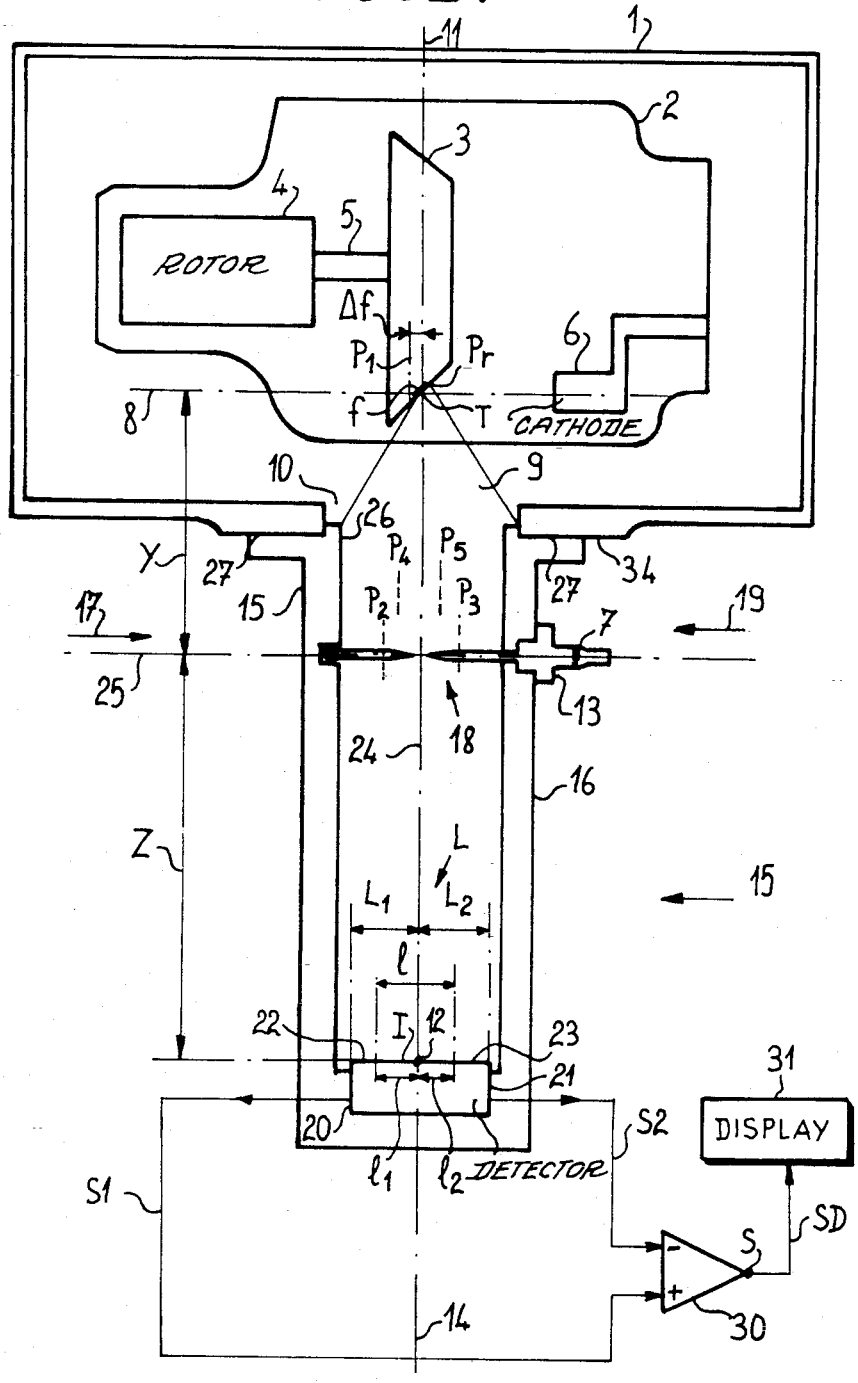
FIG. 1 a shield containing an X-ray tube combined with a control apparatus according to the invention permitting the performance of the process according to the invention.

FIG. 1 shows a first version of the control apparatus 15 according to the invention making it possible to perform the process according to the invention for controlling, within a shield 1 containing an X-ray tube 2, the position of a focus f relative to an outlet port 10 equipping shield 1.

X-ray tube 2 has an anode 3 of the rotary anode type in the present non-limitative embodiment, said anode 3 being joined to a rotor 4 by means of a shaft 5. A cathode 6 is arranged in a conventional manner facing anode 3 and in operation supplies not shown electrons determining the focus f on anode 3. Focus f constitutes the source of an X-radiation beam 9, which passes out of the shield 1 via outlet port 10.

Outlet port 10 has a geometrical axis 11 which, when the focus f is centered relative to the outlet port 10, as in the embodiment of FIG. 1, also constitutes the axis of the X-radiation beam 9. The outlet port 10 has reference faces 34 which, during the assembly of shield 1 and the not shown beam limiting device, are used for centering these elements with respect to one another.

According to the invention, the position of focus f is controlled along at least one first axis 8, which in the present embodiment is parallel to shaft 5. This position control of focus f also takes place relative to a reference position $P_r$, determined on the first axis 8 by the control apparatus 15, as will be explained hereinafter.

As focus f is shown centered relative to the outlet port 10, it occupies a theoretical position T, constituted by the intersection between geometrical axis 11 and the first axis 8. Reference position $P_r$ coincides with this theoretical position T in the embodiment of FIG. 1.

The control apparatus 15 has a support structure 16, which essentially contains a pinhole camera 18 and first and second X-radiation sensitive, contiguous detector means 20, 21 of conventional type, on which pinhole camera 18 produces an image I of focus f. The term pinhole camera is understood to mean any means having an opening or aperture making it possible to form the image of focus f, said aperture normally being shaped like a slit.

The first and second detector means 20, 21 have in each case an input plane 22, 23 respectively, arranged symmetrically with respect to a median separating line 12. As the median line 12 is perpendicular to the plane of FIG. 1, it is visible on the latter in the form of a dot or point, which symbolizes the centre of a zone on which image I is formed.

The median line 12 or image formation zone centre defines with the pinhole camera 18 a reference axis 24, whose position relative to the axis of symmetry 14 of structure 16 is defined by design. The axis of symmetry 14 and the reference axis 24 coincide in the present non-limitative embodiment.

The pinhole camera 18 is carried by a calibrated displacement means, e.g. constituted by a micrometer screw 13, making it possible to move pinhole camera 18 on either side of reference axis 24, along a second axis 25 parallel to the first axis 8. Thus, the pinhole camera 18 is mobile in one or other of the directions indicated by the first and second arrows 17, 19, the value of its displacement being known to within 1/100 mm for example, as a result of scale marks 7 on micrometer screw 13. A not shown marking makes it possible to retain the position of reference axis 24 with respect to the axis of symmetry 14.

One end 15 of support structure 16 has centering means which, in the present embodiment, are formed by a flange 26 and the second reference face 27. Said end is fixed to the shield 1 by bearing on the first reference faces 34 of outlet port 10, in which is engaged the centering flange 26. This makes it possible to assemble shield 1 and control apparatus 15 in accordance with perfectly defined and reproducible relative positions so that, in accordance with FIG. 1, reference axis 24 can be made to pass through the theoretical position T of focus f.

With the X-ray tube 2 in operation, the process according to the invention consists of causing the pinhole camera 18 to form an image I of focus f on the input planes 22, 23 of two detector means 20, 21, so as to link the position of focus f along the first axis 8 with the distribution of image I over each of the input planes 22, 23. This distribution of image I is equal on each of the input planes 22, 23 on either side of median line 12, when the reference axis 24 passing through said median line and the pinhole camera 18 also passes through the focus f.

The intersection between reference axis 24 and the first axis 8 determines the reference position $P_r$, with respect to which the focus position control takes place. Bearing in mind the application, the reference position $P_r$ coincides with the theoretical position T of focus f.

In the non-limitative embodiment of FIG. 1, the geometrical axis 11 and the reference axis 24 coincide, but this condition is not necessary and these two axes being able to form between them a not shown angle, the essential thing is that for the envisaged position control, the reference axis 24 intersects the first axis 8 at the theoretical position T, i.e. at the same point as geometrical axis 11. This is obtained with the control apparatus according to the invention as a result of its design, for a given scale mark 7 on micrometer screw 13.

The input planes 22, 23 respectively have, on either side of the median line 12, a length $L_1$, $L_2$ constituting a useful measuring length L, substantially parallel to the second axis 25 along which moves the pinhole camera 18. This useful measuring length constitutes a first dimension of the aforementioned zone on which the image is formed and whereof another dimension, perpendicular to the plane of FIG. 1, is not visible on the latter. Along the useful measuring length L, the image I has a dimension 1 less than the useful length L. It should be noted that when the image I is also distributed over the two input planes 22, 23, each of them is illuminated by the image I of focus f over a distance $\mathbf{1}_1$, $\mathbf{1}_2$ which is less than their length $L_1$, $L_2$.

Each detector means 20, 21 supplies an output signal $S_1$, $S_2$, whereof one characteristic, e.g. the amplitude, is a function of the illumination of its input plane 22, 23 by image I. Thus, e.g. by using detector means 20, 21 of the same sensitivity, they supply an output signal $S_1$,$S_2$ of the same amplitude when image I is also distributed over the two input planes 22, 23.

This configuration is shown in FIG. 1 where, focus f being centered relative to the outlet port 10, its position coincides with the reference position $P_r$, the image I is then formed in an equal manner on the two input planes 22, 23. A comparison of the output signals $S_1$, $S_2$ makes it possible to obtain a zero value difference signal SD indicating that the focus f is correctly positioned.

Assuming that on either side of the reference position $P_r$, focus f occupies a position $P_1$ along the first axis 8, represented by the dotted lines in FIG. 1, its not shown image formed by the pinhole camera 8 is then unequally distributed over the input planes 22, 23. In this case, the distance $\mathbf{1}_1$ over which the first plane 22 is illuminated by the image is less than the distance $\mathbf{1}_2$ over which the second input plane 23 is illuminated. The output signals $S_1$, $S_2$ then have a different amplitude and their comparison makes it possible to obtain a difference signal SD having a non-zero value, which can constitute a nominal value and whose polarity indicates the decentering direction of focus f.

Output signals $S_1$, $S_2$ can be compared in different known manners, such as in the presently described embodiment where the output signals $S_1$, $S_2$ are respectively applied to the positive input and negative input of a differential amplifier 30. An output S of the latter supplies the aforementioned difference signal SD, which can be displayed on a conventional display means 31.

Assuming that focus f is at position $P_1$, it is merely necessary to move the X-ray tube 2 parallel to the first axis 8 and in the direction of the first arrow 17 until the same non-zero amplification of output signals $S_1$, $S_2$ is obtained and hence a zero value of the difference signal SD, in order to bring about the position coincidence between focus f and reference position $P_r$, i.e. so as to obtain the centering of focus f relative to the outlet port 10.

It should be noted that the difference signal SD constitutes a nominal value usable for the control of the position of focus f, said difference signal SD being usable in considerations differing from that described and as will be shown hereinafter.

The position of focus f can also be controlled along a not shown axis, which differs from the first axis 8 and which is e.g. perpendicular to the latter. It is then sufficient to orient the useful measuring length L of the input planes 22, 23 along a not shown axis corresponding to the expected displacement direction of image I. It is also possible to use more than two detectors 20, 21, so as to simultaneously control the position of focus f along the first axis 8 and along said different axis.

The term control of the position of focus f, is understood to cover both the checking or servocontrol of this position, as well as the measurement of a position difference Δf between a position of focus f, such as e.g. position $P_1$, and the reference position $P_r$ along the first axis 8. The position difference Δf results either from an original positioning of focus f, or from a displacement of the latter during the operation of the X-ray tube 2.

In addition, the control apparatus and process according to the invention make it possible to express the position difference Δf, either as a function of the displacement of pinhole camera 18, or by the value of the difference signal SD in accordance with a linear relationship.

Therefore, the process also consists of placing the pinhole camera 18 at a first known distance Y from the reference position $P_r$ and placing the detectors 20, 21 at a second known distance Z from pinhole camera 18. If pinhole camera 18 is moved along the second axis 25, e.g. in the direction of the second arrow 19 from a position $P_2$ shown in dotted line form to a second position $P_3$, the difference signal SD generated by the differential amplifier 30 is subject to variations (not shown in FIG. 1) corresponding to the illumination difference between each input plane 22, 23, or the distribution difference of image I on said input planes. The first and second positions $P_2$, $P_3$ between which the pinhole camera 18 is moved correspond to positions where the latter forms a not shown image of focus f outside the input plane 22, 23. Third and fourth positions $P_4$, $P_5$ corresponding to positions between which the pinhole camera 18 simultaneously forms the image I on the two input planes.

Figure 2:
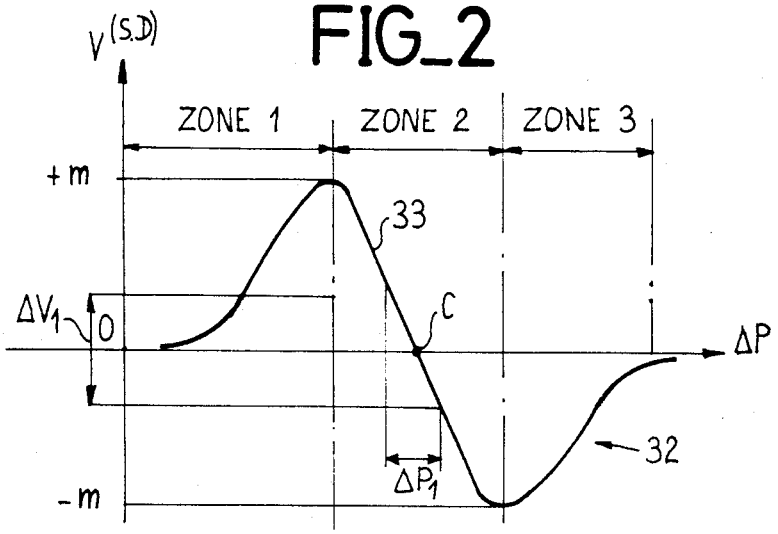
FIG. 2 a response curve of the detector means used in the control apparatus according to the invention.

FIG. 2 shows a curve 32 representing amplitude variations in Volts of the difference signal SD as a function of the displacement Δp of pinhole camera 18 along the second axis 25 in direction 19, i.e. from the first detector means 20 to the second detector means 21. This displacement Δp of pinhole camera 18 is brought about also by a micrometer screw 13 (shown in FIG. 1), which makes it possible to very finely control this displacement.

In a first zone $Z_1$, it is possible to observe that the value V of difference signal SD is firstly equal to zero and then increases to a positive maximum +m, before being reversed again as from a second zone $Z_2$, where the positive value of the difference signal decreases virtually in accordance with a straight line, to reach a negative maximum −m in the vicinity of a third zone $Z_3$, from which it is reversed again to return to a value close to zero.

Zone 1 corresponds to a formation of the image of focus f on input plane 22 of the first detector means 20 and on this alone. The second zone $Z_2$ corresponds to a simultaneous illumination of the first and second detector means 20, 21. The third zone $Z_3$ corresponds to the illumination of the second detector means 21 and to it alone.

The second zone $Z_2$ constitutes the interest zone, in which the variation of the difference signal SD can be likened to a straight line 33 passing through zero at a point C, where the illumination of the input plane 22 of the first detector means 20 is equal to the illumination of the input plane 23 of the second detector means 21. This straight line portion 33 of the curve results from the fact that an increase by a given quantity of the illumination of one of the detector means 20, 21, linked with the displacement of the image I, is accompanied by a decrease by the same illumination quantity on the part of the other detector means, assuming that the illumination distribution on the displacement axis 25 is a constant.

The value in Volts of the differential output signal SD in the straight line part 33 of curve 32, as a function of a position P such that $P_4$, $P_5$ (represented in FIG. 1) of the pinhole camera 18 is in the form $SD=aP+b$, in which a is a first constant corresponding to the slope of line 33 and which is dependent on the illumination of detector means 20, 21 and their efficiency, as well as the amplification coefficient of differential amplifier 30, whilst b is a second constant dependent on geometrical considerations of the control apparatus 15 according to the invention.

This slope or first constant a corresponds to the ratio of the voltage variation $\Delta v_1$ to the position variation $\Delta p_1$ having produced said voltage variation:

$$a=(\Delta v_1)/(\Delta p_1) \quad (1)$$

This determination of the slope a constitutes a calibration of the control apparatus 15.

It should be noted that a variation in the emission intensity of focus f leading to an overall variation of the illumination of the detector means 20, 21 can modify the slope of the line, but the latter always intersects zero at the same point C, which corresponds to an equal illumination of said detector means 20, 21.

Thus, a position of the pinhole camera 18 as read on the graduated micrometer screw 13, corresponds an electrical response in Volts by a linear application, and consequently any position variation Δp of the pinhole camera 18 is expressed by a voltage variation Δv of the difference signal SD, such that: $\Delta v = a.\Delta P$ (2).

Figure 3:
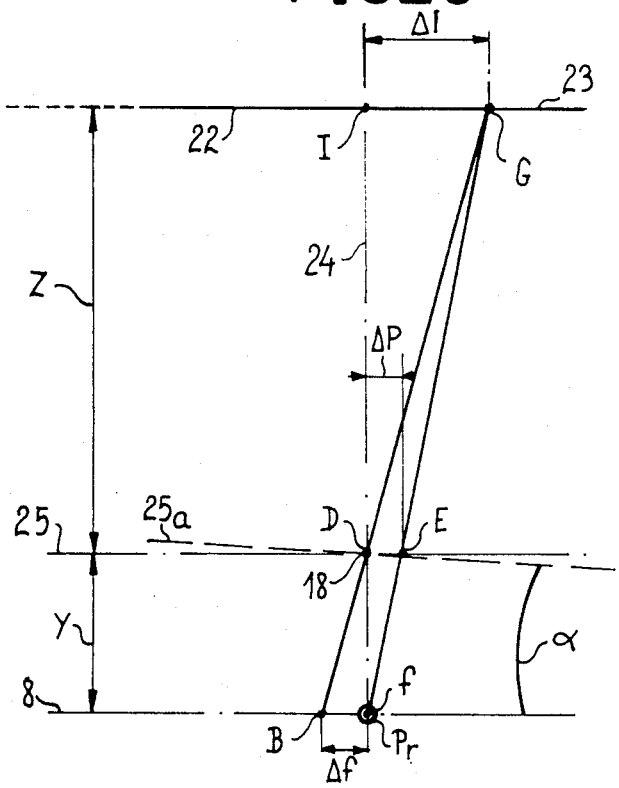
FIG. 3 a geometrical construction explaining one version of the process according to the invention.

FIG. 3 is a geometrical construction making it possible to illustrate the correlation between displacements Δf of focus f and Δp of pinhole camera 18, which produce the same displacement ΔI of image I.

In order to link a position variation Δf of focus f along the first axis 8 with a displacement Δp of pinhole camera 18 along the second axis 25, bringing about a displacement ΔI of image I of focus f, it is necessary, compared with said displacement Δp of pinhole camera 18, to express the displacement Δf of focus f which would bring about the same displacement ΔI of image I. In FIG. 3, the reference axis 24 passes through the focus f coinciding with the reference position $P_r$, the pinhole camera 18 and the image I of said focus, said image I being symbolized in FIG. 3 by a point or dot constituting its centre. Pinhole camera 18 is positioned at a first known distance Y from focus f at a point D and the input planes 22, 23 on which the image I is formed are arranged at a second known distance Z for pinhole camera 18. Thus, a known displacement Δp of pinhole camera 18 brings about a known displacement ΔI of the image.

A displacement ΔI of the image making the latter occupy a position G can either be brought about by a displacement Δp of the pinhole camera 18, so that the latter is brought into a position E, or by a displacement Δf of focus f bringing the latter into a position B.

The triangles formed on the one hand by points G, B, f and on the other by points G, D, E are similar, hence a displacement Δf of focus f is linked with a displacement Δp of pinhole camera 18 by the equation:

$$\frac{\Delta f}{\Delta p} = \frac{Z+Y}{Z} \text{ i.e. } \Delta f = \Delta p \cdot \frac{Z+Y}{Z} \tag{3}$$

It should be noted that this part of the process according to the invention is also applicable if the first and second axes 8, 25 are not parallel, as shown in FIG. 3 where a dotted line 25*a* represents the second axis and forms an angle α with the first axis. Angle α, which is generally small, is taken into acconnt in the above equation (3), which becomes:

$$\frac{\Delta f}{\cos \alpha} = \Delta p \cdot \frac{Z+Y}{Z} \tag{3'}$$

As Z and Y are known distances imposed by the design, they are constant, the only unknown in the above equation being the displacement ΔP of the pinhole camera 18, which can be determined with the aid of the aforementioned micrometer screw 13. In this configuration, therefore, it is merely necessary to move the pinhole camera 18 along the second axis 25 until an equal distribution of image I is obtained on the two input planes 22, 23, followed by the measurement of the displacement ΔP of pinhole camera 18, in order to obtain aa measurement of the position difference Δf by the aforementioned equation.

As explained hereinbefore, the displacements Δf of focus f can be expressed by a linear equation as a function of the output voltage V of the difference signal SD. Starting from the aforementioned equation 2 $\Delta v = a.\Delta p$, we obtain:

$$\Delta f = \frac{\Delta v}{a} \cdot \frac{Z+Y}{Z} \tag{4}$$

The term $$\frac{1}{a} \cdot \frac{Z+Y}{Z}$$

is a constant, which can be represented by the symbol A:

$$A = \frac{1}{a} \cdot \frac{Z+Y}{Z} \tag{5}$$

On taking up equation (4), the latter becomes:

$$\Delta f = A.\Delta v. \tag{6}$$

The latter equation indicates that a displacement Δf of focus f brings about an output variation Δv of difference signal SD in accordance with a linear law and on following the voltage variation Δv of difference signal SD, it is immediately possible to obtain the corresponding displacement Δf by a rule of three on knowing A.

As the first and second distances Y, Z are known by design, expression A only contains one unknown, the first constant or slope a. As has been stated hereinbefore, slope a is determined according to the first equation:

$$a = \frac{\Delta v_1}{\Delta p_1},$$

on the basis of a calibration consisting of displacing the pinhole camera 18 by a known value using micrometer screw 13 and measuring the corresponding variation $\Delta v_1$ of difference signal SD. In this calibration, the values of the displacements $\Delta p_1$ of pinhole camera 18 are preferably large compared with the possible displacements of focus f during this calibration.

The control apparatus 15 according to the invention, as described hereinbefore, constitutes a high sensitivity apparatus which can be used in the laboratory, the displacements Δf of focus f which are discernable being approximately 1 micrometer.

In this first version of the invention, the support structure 16 has centering means 26, 27 for cooperating with the reference faces 34 of the outlet port 10, so as to mechanically reference with respect to the latter the control apparatus 15. Reference axis 24 is positioned by design and passes through the theoretical position T of focus f.

Another version of the invention consists of mechanically referencing the control apparatus 15 with respect to an element of a radiological installation relative to which the position control of focus f is to be performed.

The process according to the invention makes it possible to control the position of the X-ray tube focus during the normal operation of a radiological installation and without blocking the outlet port 10. As stated hereinbefore, the position of the focus can be of vital importance for the quality of the image, particularly in the field of tomo-scanning and particularly in scanography. Position variation Δf of focus f being possibly due e.g. to mechanical clearances or expansions.

Figure 4:
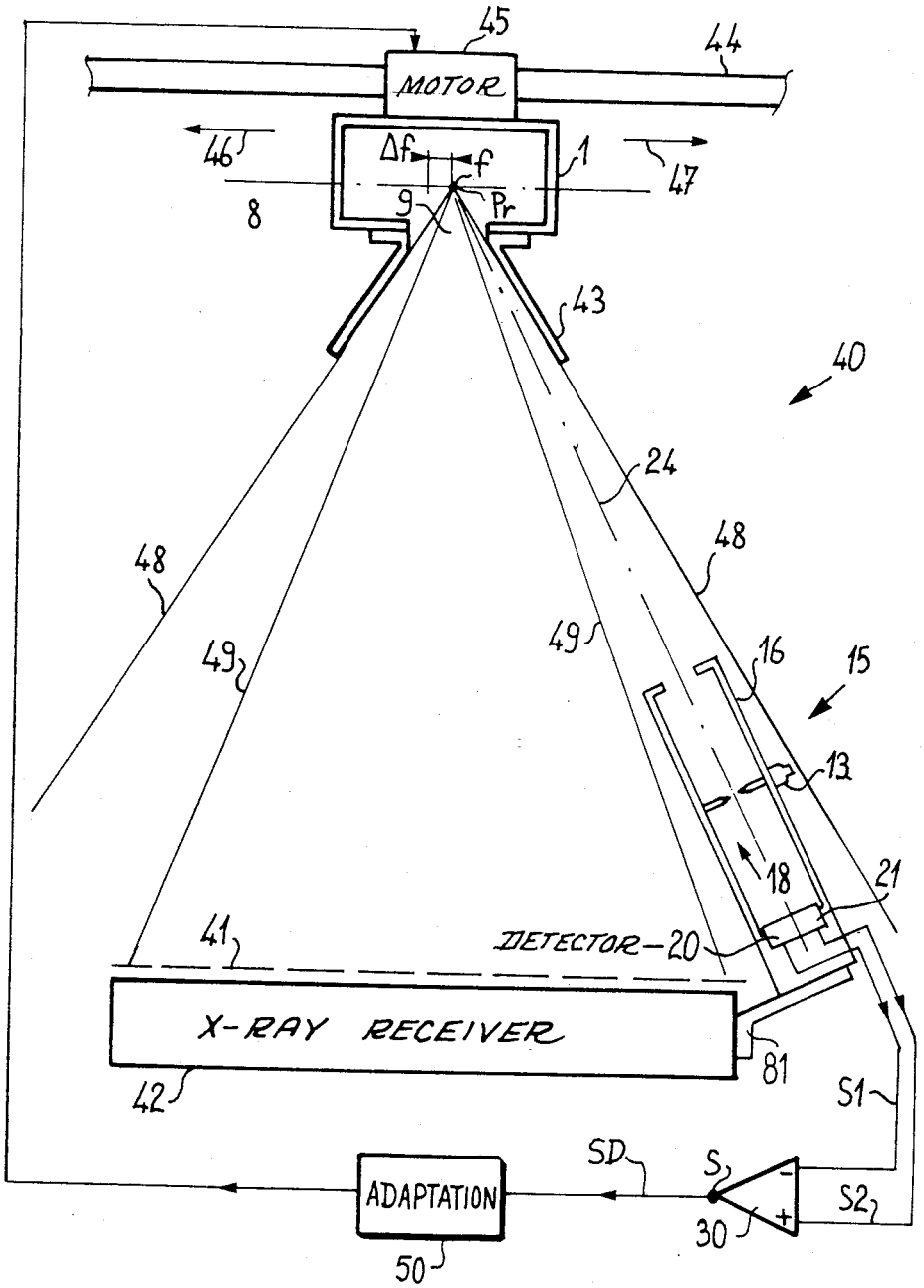
FIG. 4 a radiological institution in which the control process and apparatus according to the invention perform a closed loop control or servocontrol of the focus position.

FIG. 4 diagrammatically shows a radiological installation 40, represented in part by elements essential to the understanding of the invention.

In this non-limitative embodiment, shield 1 is positioned in a conventional manner above an irradiation plane 41 constituted by a patient-carrying table (indicated by the dotted lines), beneath which is positioned an X-radiation receiver 42.

Shield 1 is assembled with the beam limiting device 43 and is supported in a conventional manner by a rail 44 via a motorized carriage 45. Rail 44 is arranged parallel to the first axis 8 along which is controlled the position of focus f. Thus, shield 1 can move along rail 44 in one or other of the directions indicated by the third and fourth arrows 46, 47.

The X-ray tube 2 (not shown in FIG. 4) is contained in shield 1 and produces the X-radiation beam 9 from focus f. The projection of beam 9 defines on the irradiation plane 41 an irradiation field inscribed in the first limits 48, between which there is a useful field, called the useful radiological field, inscribed in second limits 49 and in which there are acceptable illumination and definition differences.

Between the first and second limits 48, 49 of these two beams, there is a zone utilizable for performing the process according to the invention without disturbing the operation of the radiological installation. In this zone is arranged the control apparatus 15, whose support structure 16 is joined to the receiver means 42 by conventional fixing means, such as e.g. beams 81. In the non-limitative embodiments described, structure 16 is of the monoblock type as indicated hereinbefore, but it can also be constructed so as to permit a separate installation of the pinhole camera 18 and the detector means 20, 21. The essential thing is that in this version of the invention, it is mechanically independent of shield 1, but dependent on the chosen reference means i.e. in this case receiver means 42.

The position of focus f can be controlled by linking a displacement Δf with a displacement Δp of the pinhole camera 18, as stated hereinbefore, by applying equation 3:

$$\Delta f = \Delta p \cdot \frac{Z + Y}{Z}$$

It can also be carried out by linking the displacement Δf of focus f with a variation of the difference signal SD according to equation 4:

$$\Delta f = \frac{\Delta v}{a} \cdot \frac{Z + Y}{Z}$$

the slope a having been determined by a prior calibration.

However, it is pointed out that the slope a can have different values as a function of the intensity of the X-radiation produced, i.e. the intensity of the illumination by image I of focus f to which are exposed the first and second detector means 20, 21. Thus, during use, an X-ray tube is subject to different operating conditions (accelerating voltage, electron rate), the intensity of the illumination of the detector means 20, 21 then being different for each operating condition, so that there is a variation of the slope of the straight line forming the calibration slope, the stronger the operating conditions of the X-ray tube, the more pronounced said slope.

According to another very important feature of the invention, all the straight lines produced by the different operating conditions of the X-ray tube pass through the same point C, which corresponds to an equal illumination of each detector means 20, 21 and said point is independent of the operating conditions. This particular aspect is used in the process according to the invention for bringing about a closed loop control of the position in the space of focus f.

The process according to the invention then consists of orienting the reference axis 24 so that it passes through focus f, so that coincidence is brought about between the latter and the reference position $P_r$ and there is an equal illumination on each detector means 20, 21 and a zero value of the difference signal SD generated by differential amplifier 30.

It then suffices to apply the difference signal SD to conventional electronic matching means 50 to control the displacement of the motorized carriage 45 as soon as a position variation Δf of focus f leads to a variation in the difference signal SD. Thus, the latter constitutes an error signal which, depending on whether it is positive or negative, controls the displacement of carriage 45 along rail 44 in one or other of the directions indicated by arrows 46, 47. In this case, it is the position of shield 1 which is modified for reestablishing the position of focus f i.e. the position in which focus f coincides with the reference position $P_r$.

The special aspect constituted by the fact that for an equal illumination on each detector means 20, 21 there is a point C which is independent of the operating conditions of the X-ray tube, or the difference signal SD is zero is also utilized in the process according to the invention for providing a control loop making it possible to determine values of the displacement Δf of the focus f.

Figure 5:
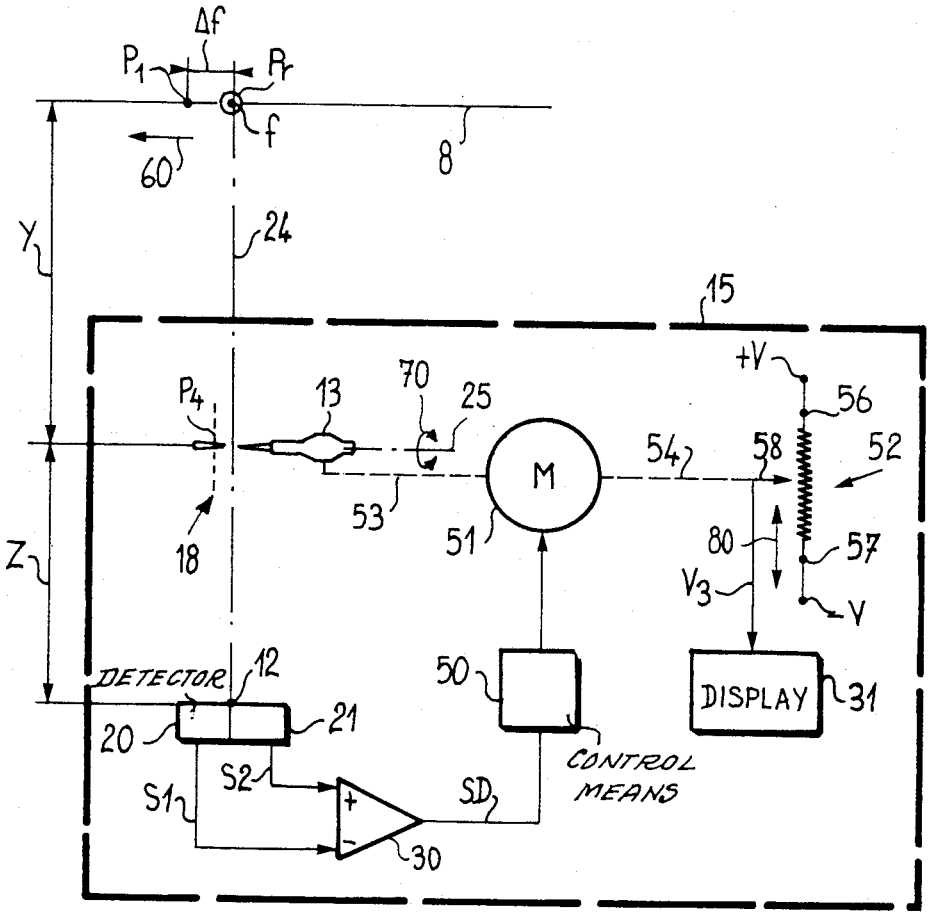
FIG. 5 a control loop according to which the control apparatus performs a final variant of the process according to the invention.

FIG. 5 shows the basic circuit diagram of a control loop constituted in the control apparatus 15 (shown in a dotted line frame) making it possible to perform the last part of the process according to the invention. The said last part of the process is also applicable to a radiological installation, not shown in FIG. 5, where only the focus f is shown for the greater clarity of the drawing.

For an initial position of focus f, said part of the process consists of bringing about coincidence between the latter and the reference position $P_r$ by acting e.g. on the micrometer screw 13, in order to bring about a displacement of the pinhole camera 18 and bring about an equal illumination on each detector means 20, 21, so that the output signal SD supplied by the differential amplifier 30 is zero. Difference signal SD is applied to control means 50 of a motor 51. The latter is mechanically coupled in rotation on the one hand to the micrometer screw 13, which it rotates in accordance with the sixth arrow 70 about the displacement axis 25 of pinhole camera 18 and on the other hand to a recording means constituted in the present case by a recording potentiometer 52. These mechanical couplings are brought about by conventional means, symbolized in FIG. 5 by first and second dotted line connections 53, 54. The recording potentiometer 52 is supplied with a voltage between −V and +V applied respectively to its first and second ends 56, 57. The slider 58 of said recording potentiometer 52 is connected to a display means 31, e.g. a voltmeter, to which it supplies an information $V_3$.

In this configuration, if focus f moves to occupy e.g. a position $P_1$, the image of the said focus is no longer distributed in an equal manner over the first and second detector means 20, 21 and the difference signal SD which constitutes an error signal passes from a zero value to a negative or positive value as a function of the direction, indicated by the fifth arrow 60, of said displacement $\Delta f$ of focus f. This positive or negative value of difference signal SD forms an error signal for actuating motor 51, the latter bringing about the displacement $\Delta p$ of the pinhole camera 18 in the direction indicated by the fifth arrow 60. This control of motor 50 is continued up to the time where the pinhole camera 18 reaches a position $P_4$, where it reestablishes the equilibrium of the illuminations of the first and second detector means 20, 21. This position is that where the reference axis 24, displaced by the movement of pinhole camera 18, passes through the position $P_1$ occupied by focus f.

As motor 51 has simultaneously brought about the displacement $\Delta p$ of pinhole camera 18, as well as that of the slider 58 and indicated by the eighth arrow 80, the latter determines a variation $\Delta v_3$ of the information $v_3$ which it supplies to voltmeter 31. This variation $\Delta v_3$ is positive or negative as a function of the displacement direction of pinhole camera 18 and is proportional to said displacement.

In addition, the variation $\Delta v_3$ of information $v_3$ represents the displacement $\Delta p$ of pinhole camera 18, e.g. following a calibration with respect to the scale marks (not shown in FIG. 5) of the micrometer screw 13 and makes it possible to determine the value of the displacement $\Delta f$ of the corresponding focus f in accordance with the equation:

$$\Delta f = \Delta v_3 \cdot \frac{Z + Y}{Z}$$

in which Y is the first distance between reference position $P_r$ and pinhole camera 18 and Z is the second distance between pinhole camera 18 and detector means 20, 21.

What is claimed is:

1. A process for controlling the position of the focus of an X-ray tube which has a first axis, said X-ray tube being contained in a shield and produces an X-ray beam passing out of the shield through an outlet port, said X-ray tube including means to displace said X-ray tube along said first axis relative to said shield said process comprising the steps of:

obtaining an image of said focus using pinhole camera means;

centering the pinhole camera means along a reference axis intersecting said first axis at a point constituting a reference position relative to which said control is performed;

forming said image on input planes of at least two contiguous, X-radiation sensitive, detector means, said input planes being separated by a median line through which passes said reference axis; and comparing the output signals generated by each of the detector means as a function of the distribution of the image, in a way so that a difference signal having zero value will be obtained when the focus occupies said reference position.

2. A process according to claim 1, comprising the further steps of: disposing said pinhole camera means and said detector means in a support structure, so that said reference axis passes through the median line thereof, and said pinhole camera means is positioned by design relative to an axis of symmetry of the support structure; and fixing the support structure against the outlet port of the shield by using reference faces with which said outlet port is provided, so that said intersection between said reference axis and said first axis realizes the reference position at a point constituting a theoretical position of the focus.

3. A process according to claim 2, comprising the further step of displacing the X-ray tube relative to the shield parallel to the first axis, until a difference signal is obtained which corresponds to an equal distribution of the image over each of the input planes, indicating that the position of the focus coincides with the reference position and the theoretical position.

4. A process according to claim 1 comprising the further steps of:

placing the pinhole camera means at a first known distance Y from the reference position;

fitting the pinhole camera means so that it can move along a second axis with respect to the reference axis; and positioning the input plane at a second known distance Z from the pinhole camera means, so that a known displacement of said pinhole camera means brings about a known displacement of the image on the input plane, thus making it possible to link a position difference of the focus with the displacement of said pinhole camera means.

5. A process according to claim 4, wherein, the second axis is parallel to the first axis, and comprising the further steps of bringing about a displacement of the pinhole camera means by a distance $\Delta p$ until a zero value difference signal is obtained corresponding to an equal distribution of the image on said input planes;

measuring of the displacement value $\Delta p$; and determining the value of the position of the focus, $\Delta f$, by the following equation:

$$\Delta f = \Delta p \cdot \frac{Z + Y}{Z}$$

6. A process according to claim 4, wherein, the second axis forms a relatively small angle $\alpha$ with the first axis, and comprising the further steps of:

bringing about the displacement of the pinhole camera means by a distance $\Delta p$ until a difference signal is obtained which corresponds to an equal distribution of the image over the input planes;

measuring the value of the displacement $\Delta p$ of the pinhole camera; and determining the value of a position difference of the focus $\Delta f$ according to the following equation:

$$\frac{\Delta f}{\cos \alpha} = \Delta p \cdot \frac{Z + Y}{Z}$$

7. A process according to claim 4, comprising the further steps of:

calibrating the system by displacing the pinhole camera means as and determining a slope a of a straight line according to which the difference signal varies, so as to link a variation of the difference signal $\Delta v$ with a position difference of the focus $\Delta f$ having produced said variation by the following equation:

$$\Delta f = \frac{\Delta v}{a} \cdot \frac{Z + Y}{Z}.$$

8. A process according to claim 4, comprising the further steps of:

orienting the reference axis to bring about a coincidence between the reference position and the position of the focus and to obtain a predetermined value difference signal at this position;

applying the difference signal to a motor means which is also coupled to means for displacing the pinhole camera means and to a recording means which supplies an information signal, so that a position difference between the focus and the reference position leads to a variation in the difference signal;

producing a non zero value error signal to be applied to the motor means when there is a position difference between the focus and reference positions, so that said motor means displaces said pinhole camera means until said predetermined value difference signal is obtained indicating the equality of the distribution of the image over the two input planes being reestablished corresponding to a zero value of said difference signal;

obtaining a variation of the information signal $\Delta v_3$ corresponding to the value of the displacement of the pinhole camera, and, determining the value of the position difference of the focus $\Delta f$ in accordance with the following equation:

$$\Delta f = \Delta v_3 \cdot \frac{Z + Y}{Z}.$$

9. A process according to claim 1 wherein said pinhole camera means and said detector means are mechanically linked with a reference means which is mechanically independent of the shield, and comprising the further steps of:

bringing about a coincidence between said reference position and the position of the focus to obtain an equal distribution of the image over the input planes to produce a predetermined value of the difference signal;

applying said difference signal to a motorized carriage supporting said shield and displaceable in a direction parallel to the first axis to cause a displacement of the focus and of the shield to return the focus to its initial position, where it coincides with the reference position.

10. A control apparatus for controlling the position of a focus of an X-ray tube contained in a shield along at least one given first axis and producing an X-ray beam passing out of the shield through an outlet port having a geometrical axis, comprising:

a support structure, coupled to said outlet port; means to displace said X-ray tube along said first axis relative to said shield means to displace said X-ray tube along said first axis relative to said shield pinhole camera means for producing an image of said focus;

two X-radiation sensitive, contiguous detector means, each having an input plane, said input planes separated by a median line, each of said detector means for detecting a position of said image of said focus and producing an indication indicative thereof comparison means for comparing output signals supplied by said detector means, to determine a distribution of the image over the input planes, so that the position of the focus can be determined from a value of said difference signal corresponding to said image distribution.

11. A control apparatus according to claim 10, wherein said comparison means includes a differential amplifier.

12. A control apparatus according to claim 10, wherein said geometrical axis passes through said pinhole camera means and through said median line, and intersects the first axis at a point constituting a reference position.

13. A control apparatus according to claim 12, wherein said pinhole camera means and said detector means are mounted in a support structure which has a symmetry axis, about which said support structure is symmetrical.

14. A control apparatus according to claim 13, wherein said outlet port is formed with reference faces, and the support structure includes centering means, cooperating with the reference faces of the outlet port, in order to fix the control apparatus to the shield, to obtain said reference position at a point constituting a theoretical position of the focus.

15. A control apparatus according to claim 10, further comprising calibrated displacement means for displacing the pinhole camera means along a second axis to produce a displacement of the image along said input planes as a function of the displacement of the pinhole camera means, said displacement being by a distance $\Delta p$.

16. A control apparatus according to claim 15, wherein the second axis is parallel to the first axis.

17. A control apparatus according to claim 15, wherein the calibrated displacement means is a micrometer screw.

18. A control apparatus according to claim 15, wherein said pinhole camera means is located at a first known distance Y from the reference point and said detector means are located at a second known distance Z from the pinhole camera means, so as to define a position difference $\Delta f$ between the focus and said reference position by the following equation:

$$\Delta f = \Delta p \cdot \frac{Z + Y}{Z}$$

19. A control apparatus according to claim 15, wherein the difference signal corresponds to a curve having a straight line portion corresponding to an equal distribution of the image over said input planes, a position difference between the focus and the reference position being related with a variation of the difference signal by the following equation:

$$\Delta f = \frac{\Delta V}{a} \cdot \frac{Z + Y}{Z}$$

in which, a represents the slope of said straight line, Y represents a first distance between the pinhole camera means and the reference position, and Z represents a second distance between said detector means and said pinhole camera means.

20. A control apparatus according to claim 10, wherein the support structure further comprises fixing means for coupling said support structure to a reference means of a radiological installation.

21. A control apparatus according to claim 18, further comprising motor means, mechanically coupled to the displacement means, and recording means, coupled to said motor means, for supplying information based on a position of said motor means, the reference signal being applied to the motor means in such a way that a position difference $\Delta f$ of the focus simultaneously leads to a displacement of the pinhole camera means and to a variation $\Delta v_3$ of said information from said recording means, in order to determine the position difference $\Delta f$ of the focus by the following equation:

$$\Delta f = \Delta v_3 \cdot \frac{Z + Y}{Z}.$$

22. A control apparatus according to claim 21, wherein the recording means is a recording potentiometer.

* * * * *